United States Patent [19]

Larsh

[11] 3,934,534

[45] Jan. 27, 1976

[54] MARINE VESSEL ROLL STABILIZER APPARATUS

[76] Inventor: Everett P. Larsh, 1001 E. Ridge Lane, Miami, Fla. 33157

[22] Filed: Aug. 16, 1974

[21] Appl. No.: 498,171

Related U.S. Application Data

[62] Division of Ser. No. 273,331, July 19, 1972, Pat. No. 3,842,777.

[52] U.S. Cl. ..... 114/122; 114/124

[51] Int. Cl.[2] ..... B63B 39/00

[58] Field of Search ..... 114/121, 122, 124, 126

[56] References Cited

UNITED STATES PATENTS

| | | | |
|---|---|---|---|
| 1,853,069 | 4/1932 | Minorsky | 114/124 |
| 3,265,029 | 8/1966 | Laurenti | 114/122 |
| 3,687,100 | 8/1972 | Larsh | 114/126 |

*Primary Examiner*—Trygve M. Blix
*Assistant Examiner*—Stuart M. Goldstein
*Attorney, Agent, or Firm*—Jacox & Meckstroth

[57] ABSTRACT

Anti-roll apparatus for a marine vessel. A plurality of fins are carried by the vessel. Each fin is operatively moved by motor mechanism which is connected thereto by means of clutch mechanism. The motor mechanism is in continuous operation. A roll sensor unit is mounted in a position to detect roll motion of the vessel. The roll sensor unit transmits signals to the clutch mechanism in response to roll motion of the vessel. The clutch mechanism joins the motor mechanism to the fins for movement thereof in accordance with operation of the roll sensor unit. The fins are thus operatively moved to reduce and/or eliminate the roll action of the vessel.

10 Claims, 11 Drawing Figures

MARINE VESSEL ROLL STABILIZER APPARATUS

RELATED APPLICATION

This application is a division of co-pending Application Ser. No. 273,331, filed July 19, 1972, now U.S. Pat. No. 3,842,777.

BACKGROUND OF THE INVENTION

Numerous marine vessels have been provided with apparatus to reduce or to overcome roll action of the vessel. Some of the apparatus has included gyroscope devices which are usually rather expensive and/or difficult to maintain in proper operating condition. Some of the anti-roll apparatus has included valves, or pistons, or the like, which lack speed and accuracy of operation. Some of the anti-roll apparatus has included means for controlling operation of motors directly in response to roll action of the vessel. Such systems are usually slow and/or inaccurate in response.

It is therefore an object of this invention to provide marine vessel anti-roll apparatus which does not require the use of gyroscopes or the like.

It is another object of this invention to provide such apparatus which has a minimum number of moving parts.

It is another object of this invention to provide such apparatus which has very rapid response to roll action so that roll action can be readily prevented or reduced.

Another object of this invention is to provide such apparatus which functions properly even if the vessel controlled is listing.

Another object of this invention is to provide such apparatus which includes means for testing thereof when the vessel is not rolling, to insure that the apparatus is functioning properly or will function properly.

Another object of this invention is to provide such apparatus which is capable of sensing and controlling relatively low degrees of roll and which is also capable of sensing and controlling relatively high degrees of roll.

Another object of this invention is to provide such apparatus which is basically electrical-mechanical in operation, which is relatively simple in construction and which does not include any devices of the "electronic" type.

Another object of this invention is to provide such apparatus which does not include fluid conduits, valves, pistons, pumps, or the like.

Another object of this invention is to provide such apparatus which rapidly operates in response to roll action for correction action, and which is capable of anticipating roll action but which does not "over correct".

Other objects and advantages reside in the construction of parts, the combination thereof, the method of manufacture, and the mode of operation, as will become more apparent from the following description.

DETAILED DESCRIPTION OF THE PREFERRED EMBODIMENT

Figure 1:
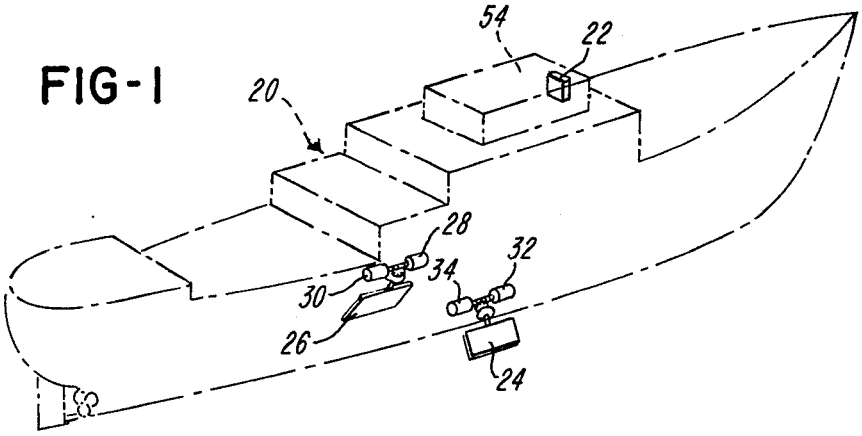
FIG. 1 is a diagrammatic perspective view showing a marine vessel provided with apparatus of this invention.
Figure 9:
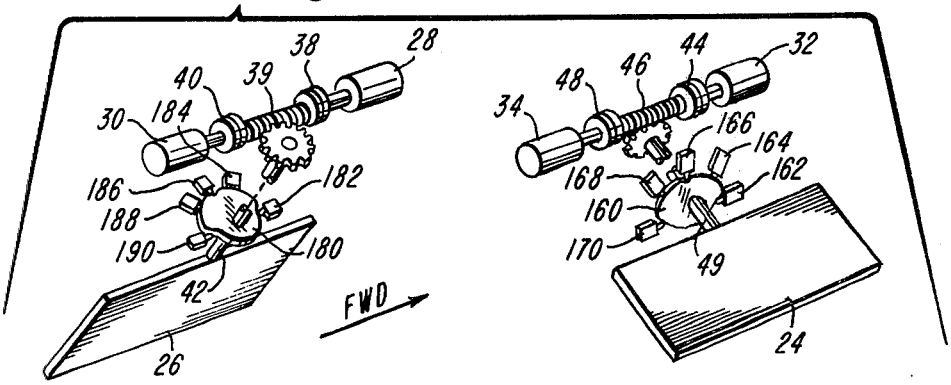
FIG. 9 is a perspective diagrammatic type of view showing a portion of the electrical and mechanical elements of this invention.

FIG. 1 illustrates a marine vessel 20 and shows the general location of a sensing unit 22, and stabilizer fins 24 and 26. FIG. 9 shows motors 28 and 30 for operation of the fin 26 and motors 32 and 34 for operation of the fin 24. FIG. 9 also shows a clutch 38, which joins the motor 28 to a gear assembly 39, and a clutch 40 which joins the motor 30 to the gear assembly 39. A shaft 42 is rotatably supported by any suitable means, not shown, and joins the gear assembly 39 to the fin 26. The motor 32 is joined by a clutch 44 to a gear assembly 46, and the motor 34 is joined by a clutch 48 to the gear assembly 46. A shaft 49 is rotatably supported by any suitable means, not shown, and joins the gear assembly 46 to the fin 24.

Figures 2, 7, 8:
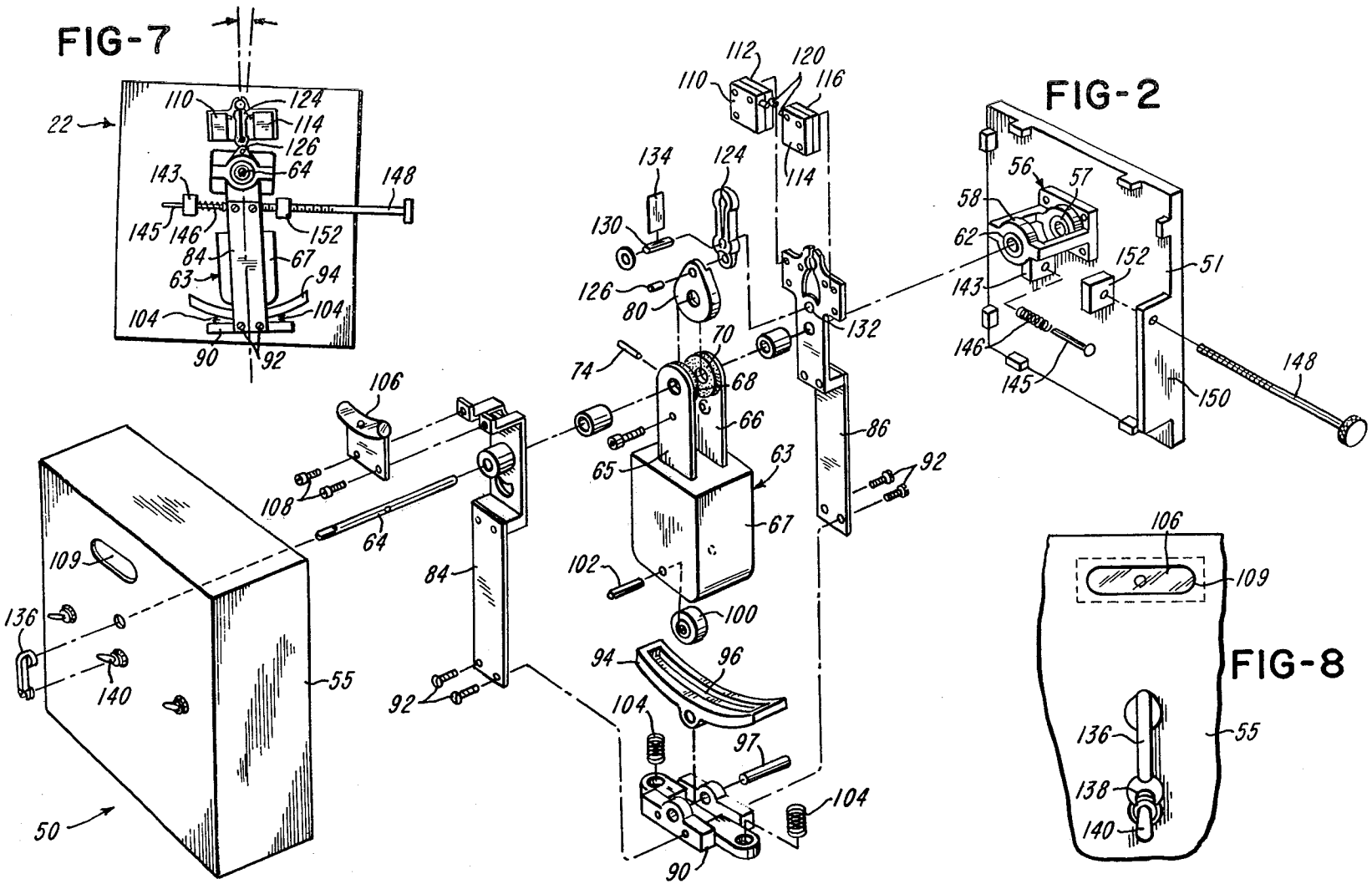
FIG. 2 is a perspective exploded view of roll sensor mechanism of this invention.
FIG. 7 is a front elevational diagrammatic type of view, drawn on smaller similar scale than the other views, illustrating the list adjustment mechanism of the roll sensor mechanism of this invention.
FIG. 8 is a fragmentary elevational view, taken substantially on line 8—8 of FIG. 4.
Figure 3:
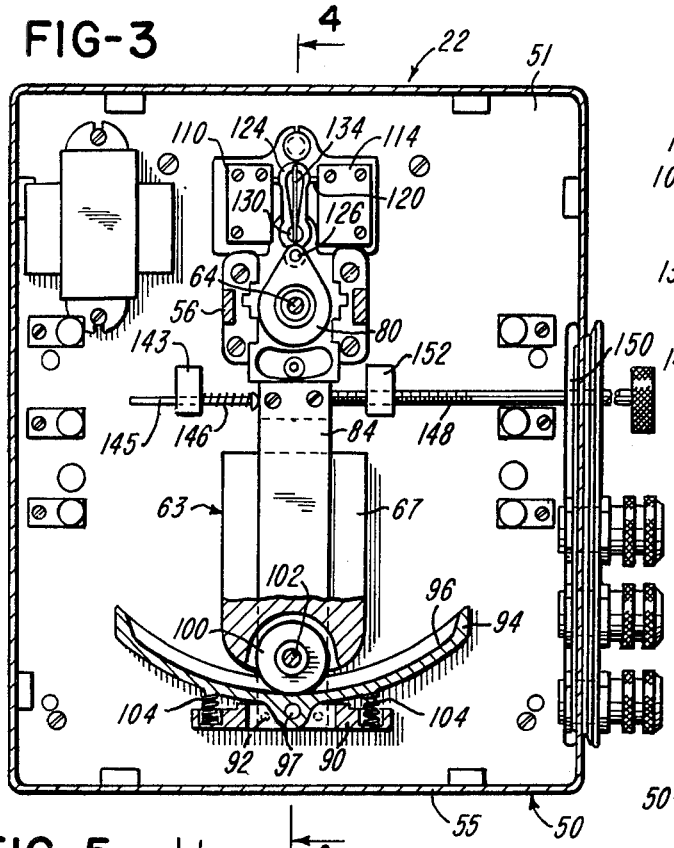
FIG. 3 is a front view, with parts shown in section, of the roll sensor mechanism of FIG. 2.
Figure 4:
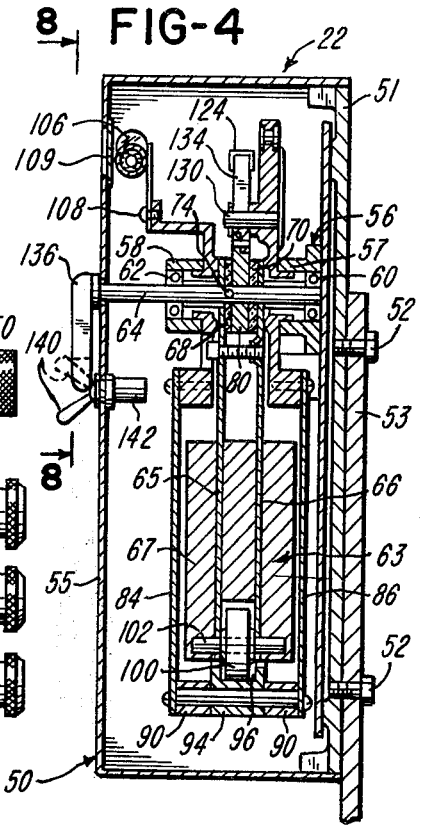
FIG. 4 is a sectional view taken substantially on line 4—4 of FIG. 3.

The sensor unit 22 comprises a housing 50, shown in FIGS. 2, 3, and 4, which, as shown in FIG. 4, is rigidly attached to a portion of support structure 53 of the vessel 20 by means of bolts 52. The housing 50 of the sensor unit 22 is preferably located in or adjacent a control station 54 of the vessel 20, as illustrated in FIG. 1.

The housing 50 comprises a base plate 51 and a cover member 55.

Secured to the base plate 51 is a bracket member 56 which has spaced-apart aligned bearing support portions 57 and 58. Within the bearing support portion 57 is a bearing 60, and within the bearing support portion 58 is a bearing 62. A shaft 64 is rotatably supported by the bearings 60 and 62. A pendulum 63 is attached to the shaft 64 and comprises spaced apart stems 65 and 66, which are carried by the shaft 64, and a weight member 67. The stem 65 has a frictional disc 68 secured thereto, and the stem 66 has a frictional disc 70 secured thereto. A pin 74 extends through a portion of the disc 68 and into the shaft 64 so that the stem 65 is non-rotatably attached to the shaft 64. A weight member 67 is attached to the stems 65 and 66 at the lower ends thereof. Rotatably mounted upon the shaft 64 and disposed between the frictional discs 68 and 70 is a connector member 80.

A leg member 84 and a leg member 86 are also pivotally supported on the shaft 64. The lower ends of the legs 84 and 86 have a pedestal 90 attached thereto by any suitable means, such as by means of screws 92. The pedestal 90 supports a dampener member 94 which is provided with an arcuate groove 96. A pin 97 pivotally attaches the dampener member 94 to the pedestal 90. Rotatably movable upon the floor of the groove 96 of the dampener member 94 is a roller 100 which is rotatably attached to the weight member 67 by means of a pin 102. The arc of the groove 96 has a lesser radius than the distance from the bottom of the roller 100 to the shaft 64. Therefore, when there is relative movement between the dampener member 94 and the pendulum 63, the roller 100 urges the dampener member 94 to pivotally move. A pair of resilient members 104 are disposed between the dampener member 94 and the pedestal 90 and urge the dampener method 94 to maintain a symmetrical position with respect to the pedestal 90.

Above the shaft 64 the leg member 84 supports a liquid level member 106 which is attached to the upper part of the leg member 84 by suitable means, such as screws 108. A window 109 in the front portion of the cover 55, permits a view of the liquid level member 106.

The upper portion of the leg 86 supports switch members 110, 112, 114, and 116, each of which has an actuator stem 120 extending therefrom. The switch members are arranged so that the switch members 110 and 112 are in juxtaposition one with the other and spaced from the switch members 114 and 116, which are also in juxtaposition. Positioned between the pairs of switch members 110 and 112, and 114 and 116 is an actuator member 124. The actuator member 124 is pivotally attached to a shaft 126 which extends into the actuator member 124 and which also extends into the upper portion of the connector member 80. The actuator member 124 is also pivotally connected to the upper portion of the leg 86 by means of a pin 130 which extends into the actuator member 124 above the shaft 126 and which also is secured within an opening 132 which is located immediately above the shaft 64 in the leg 86. A leaf spring 134 is attached to the pin 130 and is positioned within the actuator member 124 for urging axial alignment of the actuator member 124 with the connector member 80.

The shaft 64 extends through the cover 55 and has attached thereto a handle 136. The handle 136 has a notch 138 in the lower portion thereof into which a toggle 140 of a switch 142 is movable. When the handle 136 is positioned as shown in FIG. 8, the toggle 140 may be pivotally moved upwardly so that a portion of the toggle 140 is positioned within the notch 138 to prevent rotative movement of the handle 136.

A block 143 is attached to the base plate 51 adjacent the leg 84 and carries a rod 145 which is axially movable with respect thereto and which is urged by a spring 146 into engagement with the left side of the leg 84, as shown in FIGS. 3 and 7. On the right hand side of the leg 84 is a rod 148 which is threadedly supported by a flange 150 at the edge of the base plate 51. The rod 148 is also threadedly attached to a block 152 which is attached to the base plate 51. The rod 148 is engageable with the right hand side of the leg 84, as shown in FIGS. 3 and 7.

The shaft 49, which operates the fin 24, has a cam 160 attached thereto for rotation therewith. Adjacent the cam 160, for operation thereby, are switches 162, 164, 166, 168, and 170. The shaft 42, which operates the fin 26, has a cam 180 attached thereto for rotation therewith. Adjacent the cam 180 for operation thereby are switches 182, 184, 186, 188, and 190.

Figure 11:
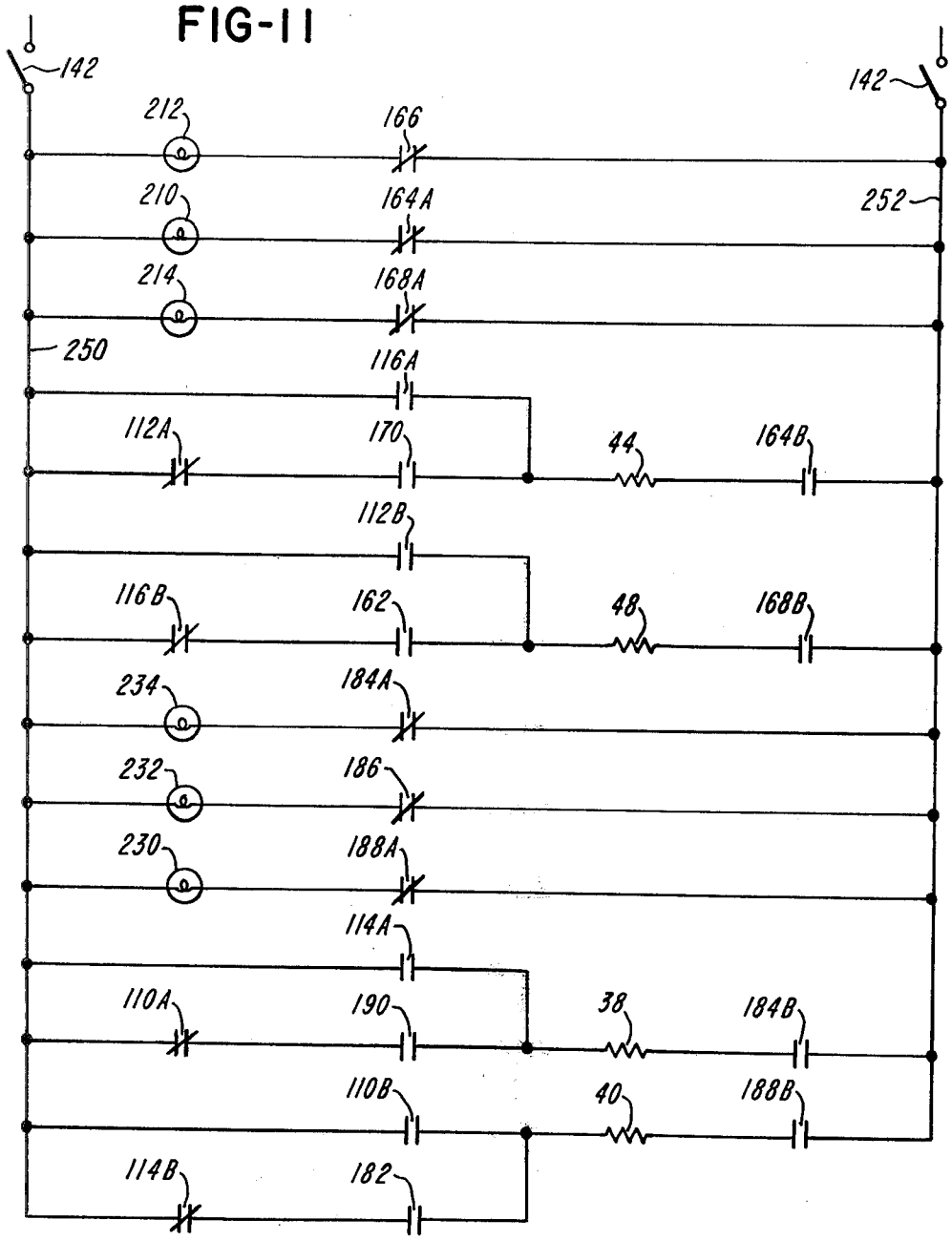
FIG. 11 is a diagrammatic view of electrical circuitry of this invention.

FIG. 11 shows digrammatically the electrical circuitry of this invention, including the switches discussed above which are operated by the cams 160 and 180. Also shown in FIG. 11 are the electrical portions of the clutches 38, 40, 44, and 48 which operate to cause rotative movement of the fins 26 and 24. Also shown in FIG. 11 are contacts of the switches 110, 112, 114, and 116 which operate by engagement with the actuator member 124. Also shown in FIG. 11 are lamps 210, 212, 214, 230, 232, and 234, which indicate the rotative position of the fins 24 and 26. These lamps may be located at any suitable positions adjacent the housing 50 or may be mounted upon the cover member 55 of the housing 50.

OPERATION

Figure 6:
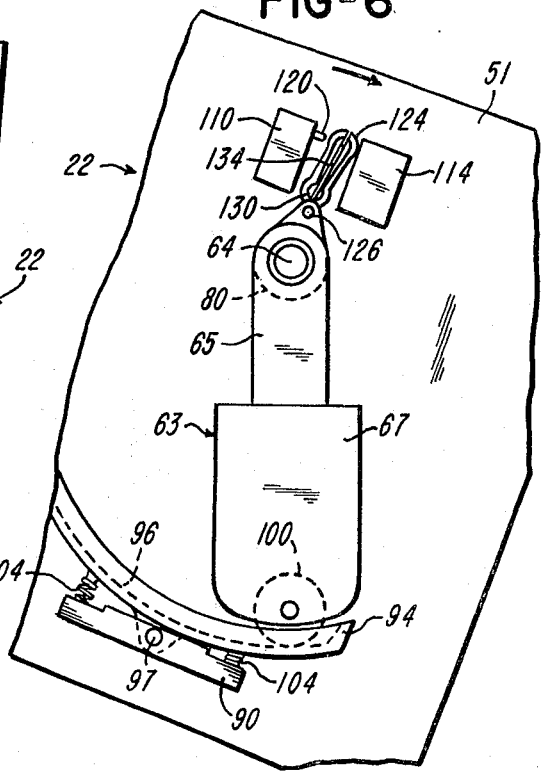
FIG. 6 is a front elevational diagrammatic type of view, similar to FIG. 5, showing further operation of roll sensor mechanism of this invention.

While the vessel 20 is tied up at dock or is otherwise substantially stationary, level member 106 is adjusted to level position as illustrated in FIGS. 7 and 8. Such adjustment is made by rotatively or threadedly moving the rod 148, which is in engagement with the right hand side of the leg 84. The leg members 84 and 86 are attached together through the pedestal 90, and the pedestal 90 pivotally supports the dampener member 94. Adjustment of the rod 148 thus pivotally moves the legs 84 and 86 about the shaft 64. Such adjustment is made until the liquid level member 106 is level as it appears through the window 109. When the liquid level member 106 shows a level position, the legs 84 and 86 are vertical, regardless of the angular position of the vessel 20. For example, as illustrated in FIG. 6, the vessel 20 may be in a starboard list condition when the liquid level member 106 is adjusted to a level position. It is to be observed that such an adjustment of the liquid level device 106 moves the leg members 84 and 86 which carry therewith the pedestal 90 and the dampener member 94. Thus, the entire roll sensing mechanism is adjusted by adjustment of the rod 148, as the pendulum 63 and the weight member 67 remain in a substantially vertical position.

However, as discussed above, the shaft 64 is attached to the handle 136, and the stems 65 and 66 of the pendulum 63 are attached to the shaft 64 for rotative movement therewith. When the toggle 140 of the switch 142 is in an upward position, and the handle 136 is in alignment therewith, the toggle 140 is disposed in the notch 138 of the handle 136. Thus, the toggle 140 prevents pivotal movement of the handle 136 when the toggle 140 is in an upward position. When the toggle 140 is in the upward position, the switch 142 is in an off position or open position.

Because the handle 136 is attached to the shaft 64 and because the shaft 64 is attached to the pendulum 63, when the toggle 140 is in its downward position the handle 136 can be pivotally moved. Such pivotal movement of the handle 136 causes pivotal movement of the shaft 64 and the pendulum 63. Pivotal movement of the pendulum 63 causes operation of the switches 110, 112, 114, and 116. Thus, the operation of the roll sensor mechanism can be tested when desired, without roll movement of the vessel 20.

The switch 142 is preferably a double-pole single-throw switch and is positioned within main control conductor members 250 and 252 of the electrical control circuitry of the invention. Therefore, when the switch 142 is in an open position, the circuitry shown in FIG. 11 is de-energized. Furthermore, when the toggle 140 of the switch 142 is in the raised position, the shaft 64 is secured against rotation, because the handle 136 is secured against rotative movement, the pendulum 63 is secured in position. Thus, when the toggle 140 of the switch 142 is in an upward position, the pendulum 63 is mechanically restrained from movement, and the roll sensor mechanism is inoperative.

The motors 28, 30, 32, and 34 are continuously rotating, as they are energized from any suitable source of electrical energy. However, the clutches 38, 40, 44, 48 are normally deenergized, and the shafts 42 and 49 and the fins 26 and 24, respectively, are normally maintained in neutral position. Thus, in order to energize the control circuitry of this invention, shown in FIG. 2, the toggle 140 of the switch 142 is moved to its lowermost position, as illustrated in FIG. 8. When the toggle 140 is so positioned, the switch 142 is closed and the conductors 250 and 252 shown in FIGS. 9 and 11 are energized.

Figure 5:
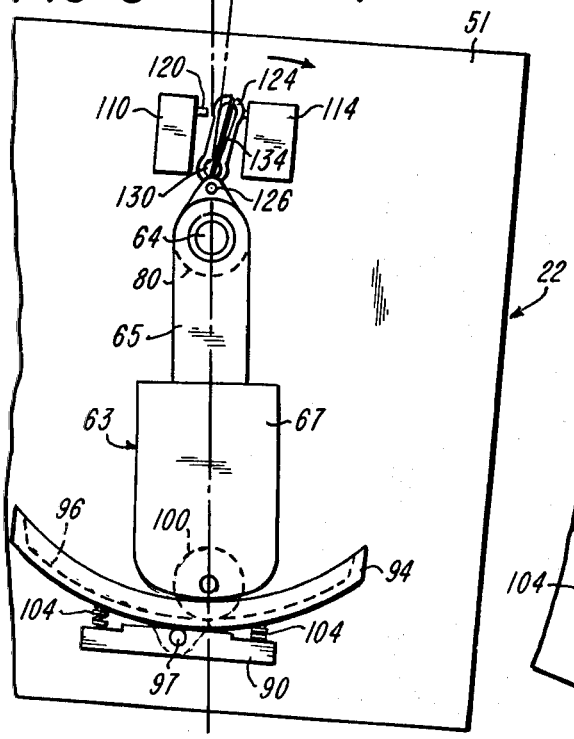
FIG. 5 is a front elevational diagrammatic type of view showing a position of operation of roll sensor mechanism of this invention.

Thus, as the marine vessel 20 is moving, the control circuitry of FIG. 11 and the roll sensor mechanism of FIGS. 2, 3, 4, 5, 6, and 7 are in condition to operate. The lamps 212 and 232 are energized and lighted through the switches 166 and 186, respectively. If the marine vessel 20 should roll to the starboard, a condition exists as illustrated in FIG. 5. In this condition there is relative rotative movement between the pendulum 63 and the base plate 51. Because there is frictional engagement between the conductor 80 and the stems 65 and 66, the connector 80 normally remains aligned with the stems 65 and 66, as shown in FIG. 5. However, with starboard roll of the vessel 20, there is pivotal movement of the actuator member 124 about the axis of the pin 130. Thus, the actuator member 124 pivotally moves into engagement with the switches 114 and 116, as shown in FIG. 5. Thus, the switches 114 and 116 are actuated. Actuation of the switch 114 causes closing of the contacts 114A and opening of the contacts 114B of the switch 114. When the contacts 114A are closed, a circuit is established from the conductor 250, through the contacts 114A to the clutch 38. The contacts 184B of the switch 184 are normally open but due to the fact that the cam 180 is in engagement with the switch 184 at this time, the contacts 184B are closed.

Figure 10:
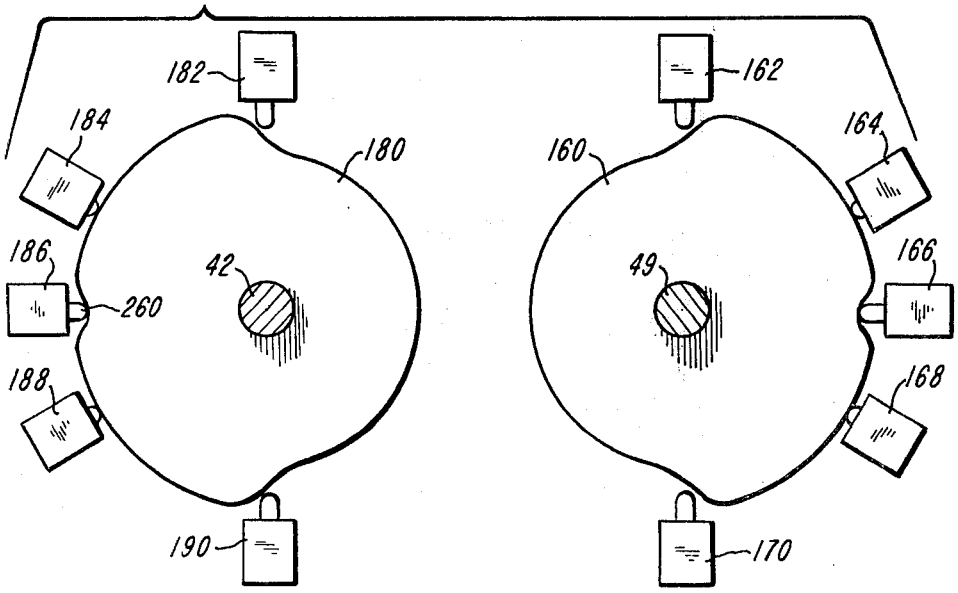
FIG. 10 is a diagrammatic type of view showing a portion of the control mechanism of this invention.

Thus, the clutch 38 is energized, and through the gear assembly 39, the shaft 42 is rotatively moved, and the fin 26 is rotatively moved in a direction to tend to overcome the roll of the vessel 20 to the starboard. For example, the shaft 42 and the cam 180, as shown in FIG. 10, rotatively move clockwise. When this occurs, the switch 186 which is normally in a recess 260 of the cam 180 is engaged by the cam 180 and the switch 186 opens and a circuit through the switch 186 is broken. Thus, the lamp 232 which is normally energized and lighted, to indicate neutral position of the fin 26, is opened and the lamp 232 is deenergized. At the same time the cam 180 engages the switch 182 and the switch 182 is thus closed.

If the vessel 20 continues its starboard roll, there is further relative movement between the pendulum 63 and the base plate 51. Thus, there is further movement of the actuator member 124 with respect to the pendulum 63. Due to the fact that the connector 80 is frictionally but slidably retained between the stems 65 and 66 of the pendulum 63, there is relative rotative movement between the connector 80 and the stems 65 and 66, as illustrated in FIG. 6.

During the relative rotative movement between the pendulum 63 and the base plate 51 during roll movement of the vessel 20, there is relative movement between the roller 100 and the dampener member 94, as illustrated in FIGS. 5 and 6. Due to the fact that the arc of curvature of the groove 96 is less than the distance from the shaft 64 to the bottom of the roller 100, pressure is exerted upon the dampener member 94 as relative rotative movement between the pendulum 63 and the base plate 51 occurs. This pressure increases as relative movement toward the position shown in FIG. 6 occurs. This pressure is absorbed by the resilient members 104. Thus, dampening action occurs with regard to relative movement between the base plate 51 and the pendulum 63 as roll of the vessel 20 occurs.

As the fin 26 rotatively moves, the cam 180 is rotatively moved, because the fin 26 and the cam 180 are both rotatively moved with rotative movement of the shaft 42. When the cam 180 has rotatively moved to a given degree from its neutral position, for example to a 30 degree position, the recess 260 of the cam 180 is aligned with the switch 184 and the switch 184 is operated so that the normally-open contact 184B is opened. Thus, the clutch 38 is deenergized and the shaft 42 and the fin 26 cease to rotatively move. At the same time, the normally closed contact 184A is closed, and the lamp 234 is lighted to indicate that the fin 26 has rotatively moved to its maximum rotative position.

When the vessel 20 ceases its starboard roll and commences to roll back toward the port side, the actuator member 124 disengages the actuator stems 120 of the switches 114 and 116, and the actuator member 124 engages the stems 120 of the switches 110 and 112. Thus, the normally-open contacts 114A open and the normally-closed contacts 114B close. Due to the fact that the switch 182 was previously closed when the shaft 42 began rotative clockwise movement, and due to the fact that the contacts 188B are closed by the cam 180, a circuit is established through the clutch 40 for energization thereof. Thus, the shaft 42 and the fin 26 immediately begin rotative movement in the counterclockwise direction. Thus, the fin 26 rotatively moves toward a position to oppose port roll of the vessel 20 during the time the vessel 20 is rolling from the starboard side toward the port side. Thus, when the vessel 20 rolls from a starboard angle to a port angle, the fin 26 is already prepared to oppose port roll of the vessel 20.

However, prior to assuming a position to overcome roll of the vessel 20 to the port, the fin 26 moves to its neutral position shown in FIG. 10 and the switch 186 again moves into the recess 260 of the cam 180 and closes, lighting the lamp 232, indicating neutral position of the fin 26. Also, when the fin 26 rotatively moves to its neutral position, the switch 182 is disengaged from the cam 180 and opens, deenergizing the clutch 40. The clutch 40 is not again energized unless the vessel 20 continues its roll toward the port side, and if such port roll occurs, the actuator 124 engages the switches 110 and 112 and causes operation thereof. Thus, the contacts 110B and the contacts 112B are closed.

It is to be understood that during operation of the fin 26 as described above, the same operation is occurring with regard to the fin 24, as a result of the operation of the circuitry shown in FIG. 11. Thus, when port roll occurs, the clutches 40 and 48 are energized, causing rotative movement of the fins 26 and 24 in a direction to oppose port side roll of the vessel 20. Thus, during roll to the port side, operation of the circuitry of FIG. 11 and operation of the fins 26 and 24, and operation of the cams 180 and 160 and the switches operated thereby occur in a manner similar to that stated above with respect to starboard roll of the vessel 20.

If there is no roll of the vessel 20, the fins 24 and 26 are maintained in a neutral position by the circuitry of FIG. 11.

Thus it is understood that the stabilizer apparatus of this invention provides means by which roll movement of the vessel 20 is quickly and effectively opposed.

Other objects and advantages reside in the construction of parts, the combination thereof, the method of manufacture, and the mode of operation, as will become more apparent from the following description.

The invention having thus been described, the following is claimed:

1. Roll sensor mechanism for a marine vessel for sensing roll movement thereof, of the type having support structure, a pendulum pivotally supported by the support structure, the pendulum being pivotally supported about a given pivotal axis, the improvement comprising:

means for increasingly resisting relative pivotal movement between the pendulum and the support structure, including an engagement member having an arcuate surface, engagement means carried by the pendulum and in engagement with the arcuate surface and movable with respect thereto during relative pivotal movement between the pendulum and the support structure, the arcuate surface forming an arc having a radius less than the spacing between the pivotal axis of the pendulum and the arcuate surface, the center of the arc being spaced between the arcuate surface and said pivotal axis of the pendulum, means pivotally supporting the engagement member so that relative pivotal movement between the engagement means and the arcuate surface causes pivotal movement of the engagement member, resilient means resisting pivotal movement of the engagement member and thus resisting relative pivotal movement between the pendulum and the support structure, and means responsive to relative movement between the pendulum and the support structure for control of roll of the marine vessel.

2. The roll sensor mechanism of claim 1 which includes a connector member which is pivotal about the given pivotal axis, means joining the engagement member to the connector member for support thereby.

3. The roll sensor mechanism of claim 1 which includes means for adjusting the pivotal position of the engagement member with respect to the support structure to adjust for list of the marine vessel.

4. The roll sensor mechanism of claim 1 which includes a shaft which is attached to the pendulum at the pivotal axis thereof for pivotal movement therewith for operation of a sensing element.

5. Roll sensor mechanism for a marine vessel of the type having support structure for attachment to a marine vessel, a rigid member supported by the support structure for pivotal movement about a given substantially horizontal axis, the improvement comprising:

a connector member supported by the support structure and pivotal about said given axis, means for adjusting and maintaining the pivotal position of the connector member with respect to the support structure to compensate for list of the marine vessel, means increasingly resisting relative pivotal movement between the rigid member and the support structure including a dampener member, the dampener member being supported by the connector member and pivotal about a substantially horizontal axis, the dampener member having an arcuate surface positioned below the rigid member, the arcuate surface being an arc taken from a center which is located below the said given axis, resilient means operably urging the dampener member to assume a pivotal position in which the center of the arc forming the arcuate surface is directly below said given axis, the rigid member including engagement means engaging the arcuate surface of the dampener member and movable along the arcuate surface, roll movement of the marine vessel thus causing relative pivotal movement between the connector member and the rigid member, such relative pivotal movement causing relative movement between the engagement means and the arcuate surface of the dampener member, the dampener member thus being urged to pivotally move against the forces of the resilient means, the dampener member and the resilient means thus providing increasingly greater resistance to such pivotal movement as such pivotal movement increases.

6. Roll sensor mechanism for a marine vessel of the type having a pendulum member supported for pivotal movement about a substantially horizontal axis, the improvement comprising:

a pivotal dampener member positioned below said horizontal axis and having an arcuate surface, the arcuate surface being an arc taken from a given center and having a given radius, the center of the arc being spaced between the arcuate surface and said substantially horizontal axis, the pendulum member including engagement means engageable with the arcuate surface and movable therealong, the distance from the arcuate surface to the horizontal axis of the pendulum member being greater than the given radius of the arcuate surface, roll movement of the marine vessel causing relative movement between the engagement means and the arcuate surface of the dampener member, relative movement between the engagement means and the arcuate surface of the dampener member causing pivotal movement of the dampener member, resilient means resisting pivotal movement of the dampener member, action of the arcuate surface of the dampener member and the resilient means thus creating increasingly greater resistance to such pivotal movement of the dampener member as such pivotal movement of the dampener member increases, and means responsive to relative movement between the pendulum member and the marine vessel for control of roll of the marine vessel.

7. The roll sensor mechanism of claim 6 which includes support structure, the pivotal member being supported by the support structure, a carrier member pivotally carried by the support structure, the dampener member being carried by the carrier member.

8. The roll sensor mechanism of claim 7 in which the carrier member is pivotally movable about the same axis as the axis about which the pivotal member is pivotally movable.

9. The roll sensor mechanism of claim 6 in which the dampener member is pivotally movable and which includes means resisting pivotal movement of the dampener member.

10. The roll sensor mechanism of claim 6 which includes a carrier member pivotally movable about the axis of pivotal movement of the pivotal member, the dampener member being pivotally carried by the carrier member.

* * * * *